United States Patent [19]

Cleer, Jr.

[11] Patent Number: 4,564,142

[45] Date of Patent: Jan. 14, 1986

[54] HYDRONIC SYSTEM WITH CIRCULATORS CONNECTED TO A HEADER

[76] Inventor: Clarence W. Cleer, Jr., R.D. 2, Box 90, Kane, Pa. 16735

[21] Appl. No.: 616,186

[22] Filed: Jun. 1, 1984

[51] Int. Cl.[4] ..... F24D 3/00

[52] U.S. Cl. ..... 237/8 R; 237/56

[58] Field of Search ..... 237/56, 8 R, 8 C, 63

[56] References Cited

U.S. PATENT DOCUMENTS

| | | | |
|---|---|---|---|
| 2,652,069 | 9/1953 | Goheen | 237/56 |
| 2,901,176 | 8/1959 | Hoyt | 237/56 |
| 3,078,044 | 2/1963 | Brandl | 237/56 |
| 4,456,456 | 6/1984 | Pompei . | |

FOREIGN PATENT DOCUMENTS

| | | | |
|---|---|---|---|
| 391207 | 10/1908 | France | 237/56 |

OTHER PUBLICATIONS

Public Use at Tabor Lutheran Church, Kane, PA, approximately 1980.

Public Use at Sheffield Methodist Church, Sheffield, PA, approximately 1981.

*Primary Examiner*—Henry Bennett

*Attorney, Agent, or Firm*—Cushman, Darby & Cushman

[57] ABSTRACT

A hydronic multi-zone heating system mounts circulators for circulating liquid between the boiler and the zone so that all components are mounted in a common area for ease of maintenance and repair, as well as for convenient installation. Air removal is also provided from the system in a simple manner by providing an enlarged header that extends generally horizontally, and has supply pipes with open ends disposed well into the interior of the header, and below the level of liquid in the header during operation. An air vent is connected to a top portion of the header to effect removal of air that may collect. A variety of other system components, such as temperature probes, are connected to fittings extending from the header. Return pipes may also be connected to the header, and an interior wall within the header may separate the inlet from the outlet thereof, or there may be free communication. A primary circulator connected between the header outlet and the boiler may be supported by the header by cooperative mounting rings formed on the header and the primary circulator.

12 Claims, 5 Drawing Figures

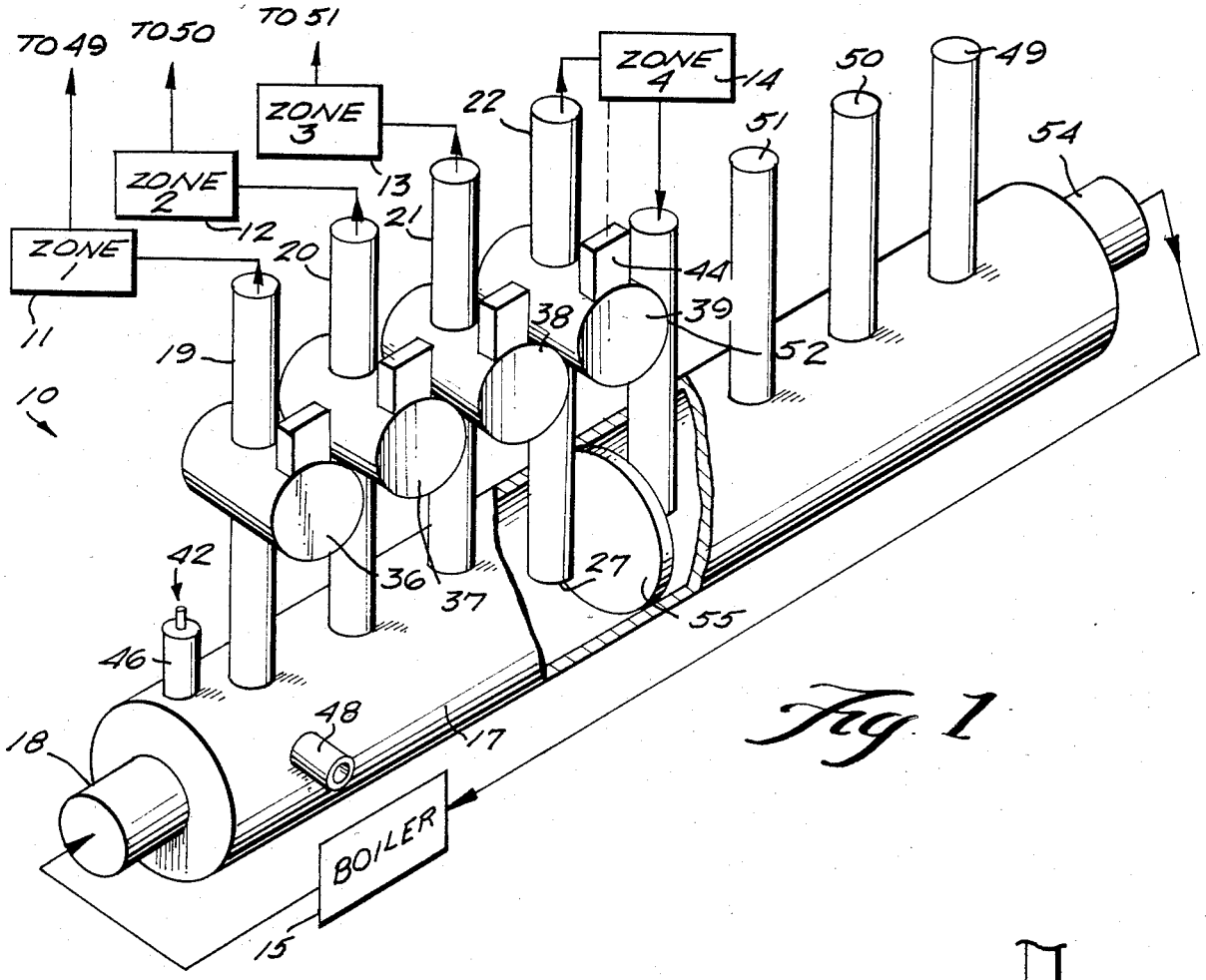
Fig. 1
Fig. 2
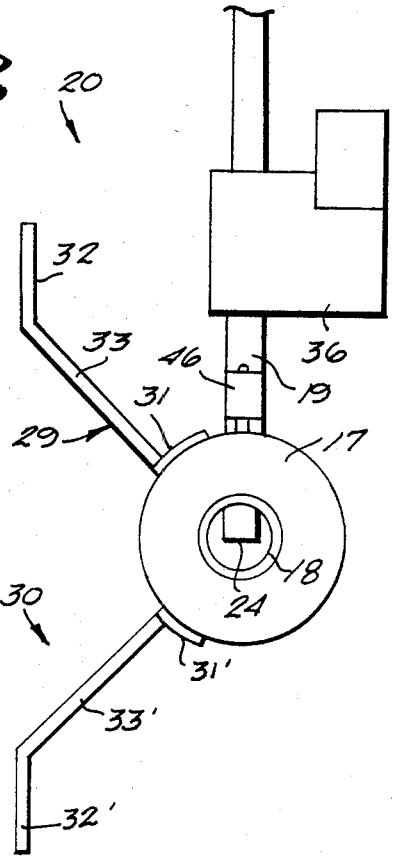
Fig. 3
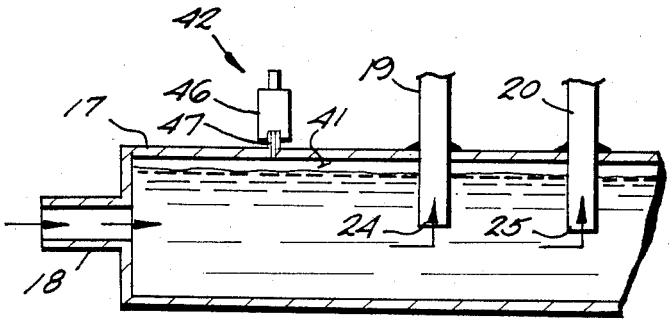

HYDRONIC SYSTEM WITH CIRCULATORS CONNECTED TO A HEADER

BACKGROUND AND SUMMARY OF THE INVENTION

In multi-zone hydronic heating systems, the two main procedures for connecting up the zones to the boiler (or other water heating device) comprise zone values—which are used with a single circulator—and a plurality of circulators, one for each zone. While the utilization of a plurality of circulators can have a number of advantages, there are some situations where the use of a plurality of circulators is impractical due to complicated piping and electrical interconnections that must be provided.

According to the present invention, a multi-zone hydronic heating installation and system are provided that significantly expand the number of situations in which a plurality of circulators can be utilized (with the resultant benefits that ensue from this manner of installation), while eliminating the complicated nature of the connections. According to the present invention, a multi-zone hydronic heating system utilizing a plurality of circulators is provided that is relatively simple to install, and provides a common area for mounting of the circulators and other components for convenience of maintenance and repair. Not only circulators but other components such as temperature probes, air vents, expansion tanks, and the like, are conveniently mounted in a central area. The invention also reduces installation costs by substituting a single header in a central location for a plurality of additional pipes and Ts that would otherwise be necessary. The invention also provides for extremely effective removal of air from the system without requiring any accessory components.

According to one aspect of the present invention, a hydronic multi-zone heating installation is provided for connection to a water heating device, such as a boiler. The installation includes a header having an inlet adapted to be connected to the water heating device, a plurality of supply pipes operatively connected at a first open end thereof to the header in fluid communication therewith and adapted to be connected at a second end thereof to a heating zone, and a circulator connected to each supply pipe for circulating liquid from the header through the supply pipe. The header is mounted so that it is generlaly horizontal, and means are provided for eliminating air from liquid in the installation. The air elimination means includes a header, the particular connection of the supply pipes to the header, and an air vent operatively connected to a top portion of the header. Since the header has a significantly larger cross-sectional area than the inlet thereto, and than each of the supply pipes, the velocity of the liquid is inherently reduced once it enters the header. This facilitates separation of air from the liquid. The air can pass through the liquid, in the header, to an upper portion of the header, at which upper portion it is vented by the air vent means. The first ends of the supply tubes extend a substantial distance into the header so that they will always be below the level of liquid in the header during operation.

A plurality of return pipes may also be connected to the header, and an outlet from the header connected to the water heating device. An interior wall may be provided in the header to prevent free passage from the inlet to the outlet thereof, or there may be free passage between the inlet and the outlet. A primary circulator may be mounted directly onto the header to circulate liquid from the header outlet to the water heating device, the mounting being provided by a pair of mounting rings held together by bolts.

A plurality of threaded fittings are provided associated with the header. At least one of the threaded fittings receives the air vent, but the other threaded fittings may receive other components such as temperature probes, expansion tanks, etc.

It is the primary object of the present invention to provide an efficient and effective hydronic multi-zone heating system. This and other objects of the invention will become clear from an inspection of the detailed description of the invention, and from the appended claims.

BRIEF DESCRIPTION OF THE DRAWINGS

FIG. 1 is a schematic perspective view, with some portions cut away for clarity of illustration, of an exemplary hydronic multi-zone heating installation according to the present invention;

FIG. 2 is an end view of the header, and accessory components, of the installation of FIG. 1;

FIG. 3 is a side cross-sectional view of a part of the header of FIGS. 1 and 2, illustrating air elimination components;

DETAILED DESCRIPTION OF THE DRAWINGS

Figure 4:
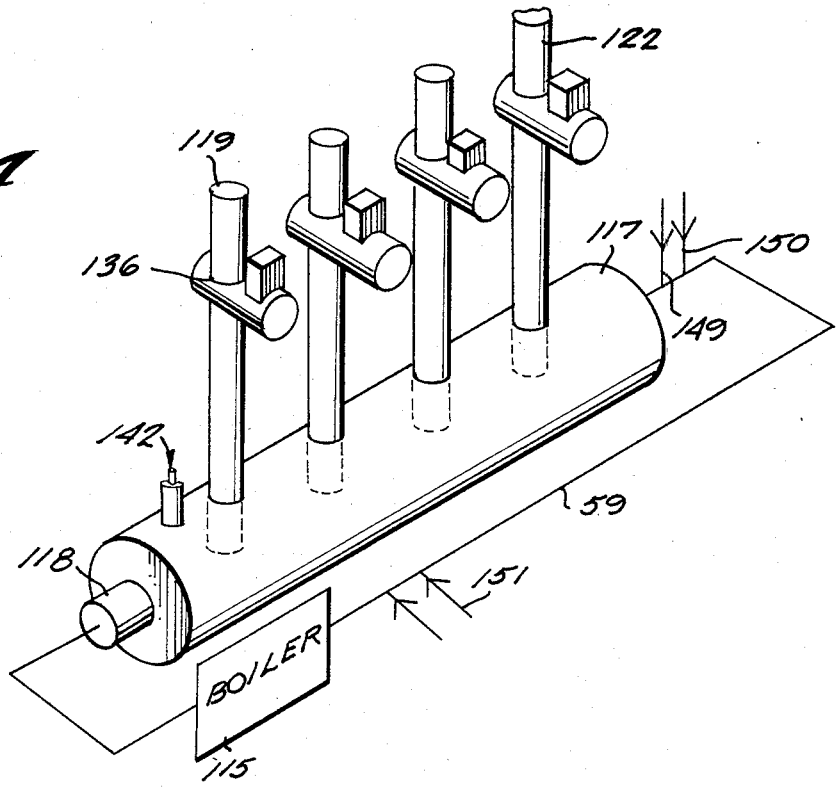
FIG. 4 is a schematic perspective view of another embodiment of the header that may be utilized in the system according to the present invention.

An exemplary hydronic multi-zone heating installation is illustrated generally by reference numeral 10 in FIG. 1. The installation is part of a system which includes a number of zones 11, 12, 13, and 14, and a boiler 15, or a like water heating device. In each of the zones 11 through 14 there commonly will be provided a radiator, or like heat transfer device, but the zones could also comprise storage tanks, domestic hot water tanks, or the like. Similarly the water heating device 15 may comprise a solar system, fossil fuel boiler, or the like, or a combination of such systems.

The primary component of the installation 10 that facilitates achievement the advantageous central location of components that is achieved according to the invention is the header 17. An inlet 18 to one end of the header 17 connects the header 17 to the boiler 15. The installation 10 also comprises a plurality of supply pipes 19–22, one for each of the zones 11–14. Each supply pipe includes a first, open end thereof (see reference numerals 24, 25, and 27 in FIGS. 1 and 3) attached to the header in fluid communication therewith, and each pipe 19 through 22 includes a second end which is adapted to be connected to a zone 11–14.

For most installations, the header 17 is mounted so that it extends generally horizontally. In such situations, a mounting means 28 for mounting it horizontally is provided. The mounting means 28, which can be seen in FIG. 2, includes a top bracket 29 and a bottom bracket 30. Each of the brackets includes a first portion 31, 31' thereof which extends along a portion of the surface of the header 17 and is rigidly connected (e.g. welded)

thereto, a second portion 32, 32' thereof which is adapted to be connected to a wall (as by bolting), and a third intermediate portion 33, 33' adapted to connect the first and second portions 31, 32; 31', 32'. A number of different upper and lower bracket sets 29, 30 may be provided along the length of the header 17 where necessary. The installation 10 further comprises a circulator connected to each supply pipe 19–22 for circulating liquid from the header 17 through that supply pipe to one of the zones 11 through 14. In FIG. 1, circulators 36–39 are respectively associated with supply pipes 19–22.

One very advantageous result that may be achieved utilizing the installation 10 is the elimination of air from the system without any separate components for that purpose. Sincce the header 17 has larger cross-sectional dimensions (e.g. a larger diameter) than either the inlet pipe 18 or any of the supply pipes 19 through 22, when the liquid enters the header 17 through inlet 18 the velocity thereof is inherently reduced. This velocity reduction allows air bubbles (illustrated schematically in FIG. 3) within the liquid to move to the top of the header 17 into a volume 41. At a top portion of the header 17, in operative communication with the volume 41, is a conventional air vent means 42 for allowing air to escape from the volume 41 to the exterior of the header 17, so that it is removed from the system. Air elimination in this system is also provided by the fact that supply tubes 19 through 22 extend into the header 17 a significant distance so that the open first ends (e.g. 24, 25, 27) thereof are always disposed below the level of liquid in the header 17 during operation of the system. The open ends 24, 25, 27 of the pipes 19–22 preferably extend to approximately the center line of the header 17, as is clearly illustrated in FIGS. 2 and 3. Thus little or no air will pass into the supply tubes 19 through 22.

A wide variety of different types of circulators 36–39 may be utilized in this practice of the invention. Of course the size of the circulators will depend upon the requirements in the particular installation. One particular type of circulator that is particularly useful is a Grundfos circulator, such as model UPS20-42F, or model UP26-96F. Typically, circulators would be controlled by an electrical control box, such as the box 44 illustrated for circulator 39 in FIG. 1. A thermostat in the zone 14 is operatively connected to the electrical control 44, and automatically turns on, controls the speed of, and/or shuts off the circulator 39 depending upon the temperature conditions in the zone 14.

The vent means 42 may also be of any conventional type, such as a Grunfos float vent 47. The vent 46 may be automatically or manually operated, and it is preferably connected to a threaded fitting 47 extending outwardly from the header 17.

A particular advantage of the header 17 is that not only does it allow all of the circulators 36–39, and the electrical controls therefor, to be centrally located (as well as a central location of the air elimination means), it also facilitates the central location of a wide variety of other accessory components that may be utilized. Preferably, a plurality of threaded fittings, such as a threaded fitting 48 illustrated in FIG. 1, are provided which are adapted to receive temperature probes, expansion tanks, and like components.

In the embodiment of the installation 10 illustrated in FIG. 1, a plurality of return pipes are also operatively connected to the header 17. These include return pipes 49, 50, 51, and 52. Each return pipe 49–52 is operatively connected to one of the zones 11–14. For instance as illustrated in FIG. 1, return pipe 52 is operatively connected to zone 14 and supply pipe 22, and return pipe 49 is operatively connected to zone 11 and supply pipe 19. It is desirable that the return pipes 49–52 be connected to the header 17 so that open ends thereof extend to approximately the center line of the header 17, just like the open ends 24, etc. of the supply pipes. However since air elimination is not a consideration in the connection of the return pipes to the header 17, the pipes 49–52 may be welded, or otherwise connected to the header 17, so that the open ends thereof are right at the surface of the header 17.

In the FIG. 1 embodiment, the outlet 54 from header 17 is operatively connected to the boiler 15, but free flow of liquid from the inlet 18 to the outlet 54 is prevented by the interior disc or wall 55, which is welded or otherwise attached to the interior of the pipe 17 and positively prevents flow of liquid from the portion of the header 17 adjacent the inlet 18 (to which all of the supply pipes 19–22 are connected) to the portion of the header 17 adjacent the outlet 54 (to which the return pipes 49–52 are connected).

The FIG. 4 embodiment is very similar to the FIG. 1 embodiment, and like components are indicated by like reference numerals only preceded by the numeral "1". However in this embodiment the return pipes are not connected directly to the header 117. Rather the return pipes are connected anywhere convenient to a return conduit 59 to the boiler 115. This embodiment is utilized in situations where it is not convenient to return from the zones directly to the header, and in this embodiment the header 117 may be vertically oriented if desired (in which case the vent 142 is provided at whatever surface of the header 117 that is the highest).

Figure 5:
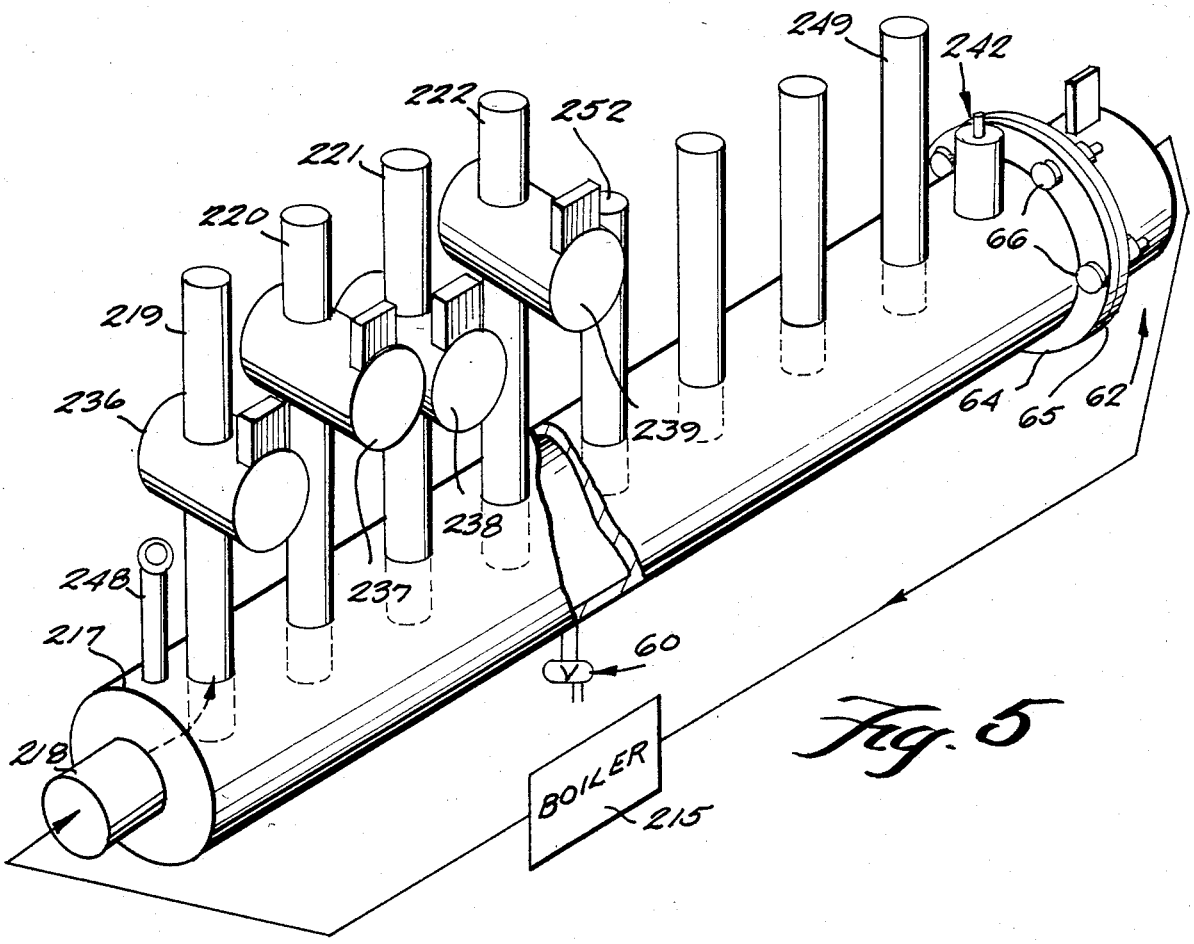
FIG. 5 is a schematic perspective view of yet another embodiment of the header, and associated components, of a system according to the present invention.

The FIG. 5 embodiment is very similar to the FIG. 1 embodiment, and like components therein are illustrated by like reference numerals only preceded by the numeral "2". In this embodiment, a drain valve 60 is shown connected to the bottom of the header 217, a drain valve being a desirable component for any of the embodiments.

The major distinctions between the FIGS. 1 and 5 embodiments are the fact that the FIG. 5 embodiment does not have an interior wall, so that free passage of liquid from the inlet 218 to the outlet thereof is provided. Also in this embodiment, a primary circulator 62 is provided for circulating liquid between the header 217 and the boiler 215. The header 217 also provides a convenient mount for the primary circulator 62. Means for mounting the circulator 62 to the header 217 preferably comprise an end ring or flange 64 formed on the end of the header 217 adjacent the outlet, and a cooperating mounting ring 65 provided on the circulator 62. A plurality of bolts 66 hold the rings 64, 65 together to properly mount the primary circulator 62 to the header 217.

In the FIG. 5 embodiment, an alternative manner for mounting the circulators 236–239 is illustrated where space is tight. The circulators 236–239, which are connected to vertically extending substantially parallel portions of the supply pipes 219–222, are vertically staggered with respect to adjacent circulators so that the pipes 219–222 may be mounted closer together.

The headers 17, 117, 217, and all supply or return pipes associated therewith, may be made from commercially available steel pipe or other materials capable of withstanding a pressure of 30 psi or greater.

It will thus be seen that according to the present invention a simple and effective multi-zone hydronic heating installation is provided having numerous advantages. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A hydronic multi-zone heating installation for connection to a water heating device, and comprising: a header having an inlet adapted to be connected to the water heating device; a plurality of supply pipes operatively connected at a first open end thereof to said header in fluid communication therewith, and adapted to be connected at a second end thereof to a heating zone; means for mounting said header so that it extends generally horizontally; a circulator connected to each supply pipe for circulating liquid from said header through said supply pipe to a heating zone;

means for eliminating air from liquid in said instllation, said means comprising: said header having a significantly larger cross-sectional area than the inlet thereto, and than each of said supply pipes; each of said supply pipes extending into said header a significant distance so that during operation said first open end of each of said supply pipes will always be below the level of liquid in the header; and air vent means operatively connected to a top portion of said header above the level of liquid for venting air therefrom;

a plurality of return pipes connected to said header, and an outlet extending from said header; said supply pipes connected to said header adjacent the inlet to said header, and said return pipes connected to said header adjacent the outlet from said header, and wherein each of said return pipes having a first open end thereof extending from the top or bottom of the header inwardly into said header to approximately the center line of said header; and said header being completely open so that liquid may flow freely through said header from the inlet to the outlet thereof.

2. A hydronic heating system comprising: a boiler; a header including an inlet to the header from said boiler; a plurality of supply pipes operatively connected at a first open end thereof to said header in fluid communication therewith, and adapted to be connected at a second end thereof to a heating zone; said header having larger cross-sectional dimensions than said inlet and than each of said supply pipes; a circulator operatively connected to each of said supply pipes for circulating liquid from said header through said supply pipe to a heating zone; thermostatic control means for controlling operation of each of said circulators in response to temperature conditions in each of said heating zones; a plurality of return pipes from said zone operatively connected to said boiler; a plurality of threaded fittings formed on said header for operative connection to operative components of said heating system; a drain valve operarively connected to the bottom of said header; said return pipes comprising a plurality of return pipes operatively connected to said header, and an outlet from said header operatively connected to said boiler, and said supply pipes being connected to said header adjacent said inlet, and said return pipes are connected to said header adjacent said outlets; and a wall disposed in an intermediate portion of said header separating portions of said header connected to said supply pipes from portions of said header connected to said return pipes so that no liquid can flow through said header directly from the inlet to the outlet thereof.

3. An installation as recited in claim 1 wherein said header includes a first threaded fitting connected to a top portion of said header, and wherein said air vent means comprises a vent connected to said first threaded fitting.

4. An installation as recited claim 3 further comprising at least one other threaded fitting, besides said first threaded fitting, operatively connected to said header for mounting other installation components.

5. An installation as recited in claim 1 further comprising a primary circulator adapted to circulate liquid from the header outlet to the water heating device, and means for mounting said primary circulator directly to said header adjacent the outlet thereof.

6. An installation as recited in claim 1 wherein said means for mounting said header so that it is generally horizontal comprises bracket means comprising top and bottom bracket sections, each bracket section including a first portion thereof following the contour of part of the header and rigidly connected thereto, a second portion thereof adapted to be connected to a wall, and a third portion thereof interconnecting said first and second portions thereof.

7. An installation as recited in claim 1 further comprising a drain valve operatively connected to the bottom of said header.

8. An installation as recited in claim 1 wherein said supply pipes extend generally vertically, and are generally parallel to each other, and wherein each of said circulators is connected to a vertical portion of its respective supply pipe; and wherein said circulators are vertically off-set with respect to adjacent circulators.

9. A hydronic heating system comprising: a boiler; a header including an inlet to the header from said boiler; a plurality of supply pipes operatively connected at a first open end thereof to said header in fluid communication therewith, and adapted to be connected at a second end thereof to a heating zone; said header having larger cross-sectional dimensions than said inlet and than each of said supply pipes; a circulator operatively connected to each of said supply pipes for circulating liquid from said header through its supply pipe to a heating zone; thermostatic control means for controlling operation of each of said circulators in response to temperature conditions in each of said heating zones; a plurality of return pipes connected to said header and an outlet from said header, said supply pipes connected to said header adjacent the inlet thereto, and said return pipes connected to said header adjacent the outlet thereof, and free flow of liquid from said header inlet to said header outlet being provided; and a primary circulator operatively connected between said header outlet and said boiler, and means for mounting said primary circulator to said header so that it is supported by said header adjacent the header outlet.

10. A system as recited in claim 9 wherein said mounting means for mounting said primary circulator comprises cooperating annular rings formed on said header adjacent the outlet end thereof, and on said circulator, and a plurality of bolts holding said rings together.

11. A system as recited in claim 2 wherein said fittings include one fitting adapted to be connected to an air vent, and an air vent threadedly connected to said fitting.

12. An installation as recited in claim 1 wherein each of said circulators is connected to a vertically extending portion of said supply pipe, and is mounted adjacent said header.

* * * * *